US005924846A

United States Patent [19]

Arnold, Jr. et al.

[11] Patent Number: 5,924,846

[45] Date of Patent: Jul. 20, 1999

[54] COVER FOR SEWER BASIN HAVING INTEGRAL CONTROL HOUSING

[75] Inventors: Larry Arnold, Jr., Trotwood, Ohio; Thomas R. Baughman, Parkville, Mo.; Jason D. Fogt, Sidney, Ohio; Douglas Milby, Troy, Ohio; Brian Mitsch, Bradford, Ohio; Art Morris, Perrysville, Ohio; Kirk W. Neer, Urbana, Ohio; Doug Strief, Milford, Ohio

[73] Assignee: Crane Pumps & Systems, Inc., Piqua, Ohio

[21] Appl. No.: 08/879,960

[22] Filed: Jun. 20, 1997

[51] Int. Cl.[6] ..... F04B 49/00

[52] U.S. Cl. ..... 417/36; 417/422; 404/25; 404/26; 50/20

[58] Field of Search ..... 417/36, 360, 361, 417/422; 50/20; 405/125, 55; 404/25, 26

[56] References Cited

U.S. PATENT DOCUMENTS

| | | | |
|---|---|---|---|
| 3,875,051 | 4/1975 | Kovarik | 210/2 |
| 4,709,723 | 12/1987 | Sidaway et al. | 137/584 |
| 4,896,705 | 1/1990 | Podgers et al. | 141/86 |
| 5,401,114 | 3/1995 | Guggemos | 404/25 |
| 5,553,794 | 9/1996 | Oliver et al. | 241/36 |
| 5,727,351 | 3/1998 | Neathery et al. | 52/20 |

*Primary Examiner*—Charles G. Freay
*Assistant Examiner*—Paul Ratcliffe
*Attorney, Agent, or Firm*—Oldham & Oldham Co., L.P.A.

[57] ABSTRACT

A cover for a sewer basin with a pump is provided with upper and lower members. The bowl-like lower member has a central cavity which may be closed in a water-tight fashion by placement of the upper member onto the lower member in a frictional fit. A flanged surface on the lower member allows it to be sealed in water-tight relationship over a maintenance entry into the basin. A control panel for the pump is mounted in the central cavity. Access may be had to the control panel without a need to open the basin, and access may be had to the basin interior without a need for opening the central cavity or the control panel housed therein.

6 Claims, 4 Drawing Sheets

COVER FOR SEWER BASIN HAVING INTEGRAL CONTROL HOUSING

The present invention relates to a cover for a sewer basin as is known in the prior art. More particularly, the invention relates to a sewer basin cover wherein the cover is provided with a plenum for containing controls which previously have been housed at a remote location external to the basin. Even more particularly, the present invention provides an ability to retrofit existing sewage basins with the novel sewage basin cover.

BACKGROUND OF THE ART

Sewage flow is typically by gravity. However, in many situations it is necessary to "lift" sewage from a location where it is generated to a point where it may be deposited into a sewage collection system. In such situations, it is well known to provide a sewage basin for collection of the sewage. Such a sewage basin would be provided with a sewage inlet, a lift pump to move the sewage out of the basin and into an exit line, and the necessary controls for operating the pump. Since these sewage stations need to operate automatically, the controls provide power to the pump and sense liquid levels in the basin. The liquid level information is used to switch the pump on and off and to turn the alarms on and off.

A gravity line for removing sewage from a building exits the building and is connected to the sewage basin. The sewage basin's location will vary with each application, due to the location of the gravity line. The current state of the art is to locate the pump control on the side of the building or on a post located near the sewage basin. The remoteness of these control positions relative to the sewage basin itself makes service work difficult. Additionally, controls mounted on the building or on a post are subject to deterioration from the natural environment surrounding the sewage basin site. When service work is required on the basin, and particularly on the electrical systems associated therewith, the current state of the art system exposes the service technician to the noxious and obnoxious materials contained within the sewage basin.

SUMMARY OF THE INVENTION

It is, therefore, an object of the present invention to provide a new design for a sewage basin wherein the control equipment is located more closely to the sewage basin, but is still isolated from the sewage basin environment so that certain maintenance procedures may be provided without requiring opening of the basin. This and other objects of the present invention are achieved by a sewage collecting and pumping device containing a pump with a control panel therefor remote from said pump. The device comprises a basin for collecting the sewage, having a maintenance entry aperture with the pump mounted in the basin, and a cover for the maintenance entry aperture, the control panel mounted inside a cavity in the cover.

BRIEF DESCRIPTION OF THE DRAWINGS

The invention will be better understood when reference is made to the accompanying drawings, wherein identical parts are identified with identical reference numerals and wherein.

DETAILED DESCRIPTION OF THE INVENTION

Figure 1:
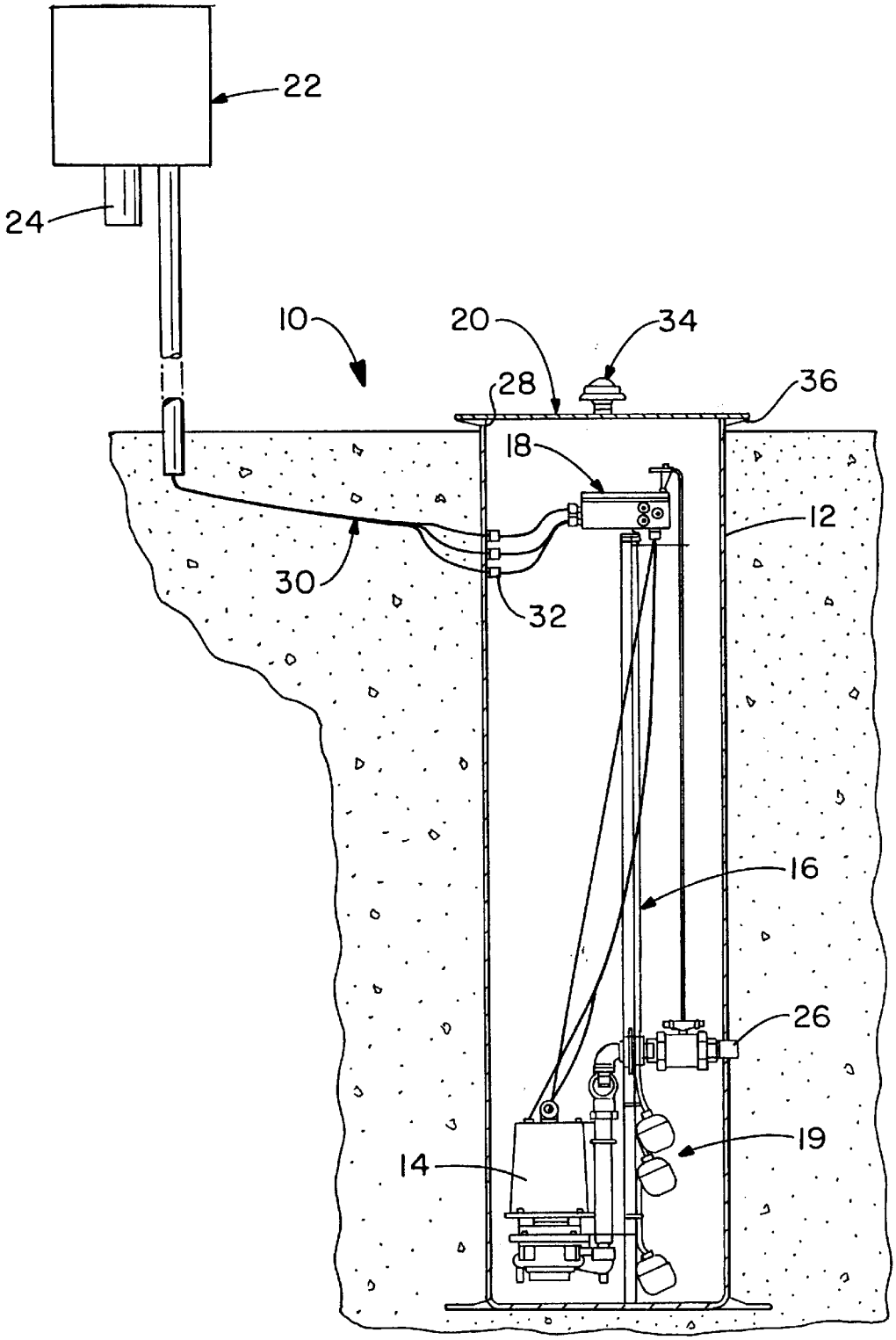
FIG.-1 Prior Art
FIG. 1 shows a partial section side elevation view of a sewage basin system of the prior art.

FIG. 1 shows a sewage basin system 10 as generally known in the prior art, in which the system is provided to pump untreated sewage or effluent on its way from a collection point to a treatment plant. A typical package for this service as known in the prior art comprises a basin 12, a pump 14, a pump removal means, shown generally as 16, an electrical junction box 18, a level sensing and control system shown generally as 19, a vented basin cover 20, an electrical control box 22, including a control panel (not shown, but inside control box 22), alarm (not shown), horn (not shown) and light 24 and a sewage exit line 26. The system 10 is typically buried, with the electrical control box 22 being the only portion of the system remaining above ground level. The basin 12 is buried with the basin cover 20 located at grade. The basin 12 is a cylinder closed on one end, typically provided with three ports or openings. The first of these is a entry port for sewage (not shown in FIG. 1); the second is an sewage exit line 26 and the third is the manway or maintenance entry 28. This third port Is the open end of the cylindrical basin 12; the first two ports being along the sides of the basin. Sewage flows into the basin 12, where it is received and collected until it is pumped out under pressure. The basin 12 must contain the pump 14, the pump removal system 16, the electrical junction box 18, and the level sensing and control system 19. The external control box 22 houses the control panel with an electrical disconnect, the alarm, horn and light 24. Electrical wiring 30 is provided to communicate the components contained in the basin 12 with the external control box 22, usually through buried cable which enters the basin through the side thereof. The point of entry of the electrical wiring 30 into the basin 12 is generally provided with water proof cable seals 32. The wiring generally runs from the external control box 22 to the junction box 18 and from the junction box to the pump 14 and level sensing and control system 19. In a typical installation, upwards of fifteen wires are involved in making the connections between the various parts. These wires would typically include four main power leads, five pump motor sensor leads and six level control leads. The accurate connection of this wiring poses a significant challenge to one charged with installation and/or maintenance of the unit, particularly in view of the conditions under which such work must be made.

Because the basin 12 receives sewage and stores it until it is pumped onward, the interior of the basin will constantly be wet and full of noxious gases. The pump 14 and level sensing controls 19 therefor will be positioned near the bottom of the basin to perform their functions effectively. Design of these components is well-known, such as providing the pump with an accompanying submersible electric motor. However, the junction box 18 will usually be positioned near the top of the basin 12, above the pump removal system 16, so that ready access is given for maintenance and to minimize exposure of the junction box to moisture. In a situation where the basin 12 becomes flooded, the junction box 18 may become submerged and the constant high humidity conditions inside the basin require that the junction box be sealed tightly against moisture. The basin cover 20 as known in the prior art is used to close the maintenance entry 28 in a watertight fashion when the basin 12 is in normal use, but a vent 34 is provided to prevent buildup of gas pressure. As is shown in FIG. 1, the maintenance entry 28 is provided with a flange 36 forming the top rim of the basin 12 for the purpose of affixation of the cover 20. In the prior art, the cover 20 is commonly comprised of fiberglass-reinforced polymeric material.

Because the junction box 18 merely connects wiring ends coming into the basin from the control panel in external control box 22 with the internal components of the basin 12, all it adds to the system as known in the prior art is a further opportunity for error in connecting wires.

Figure 2:
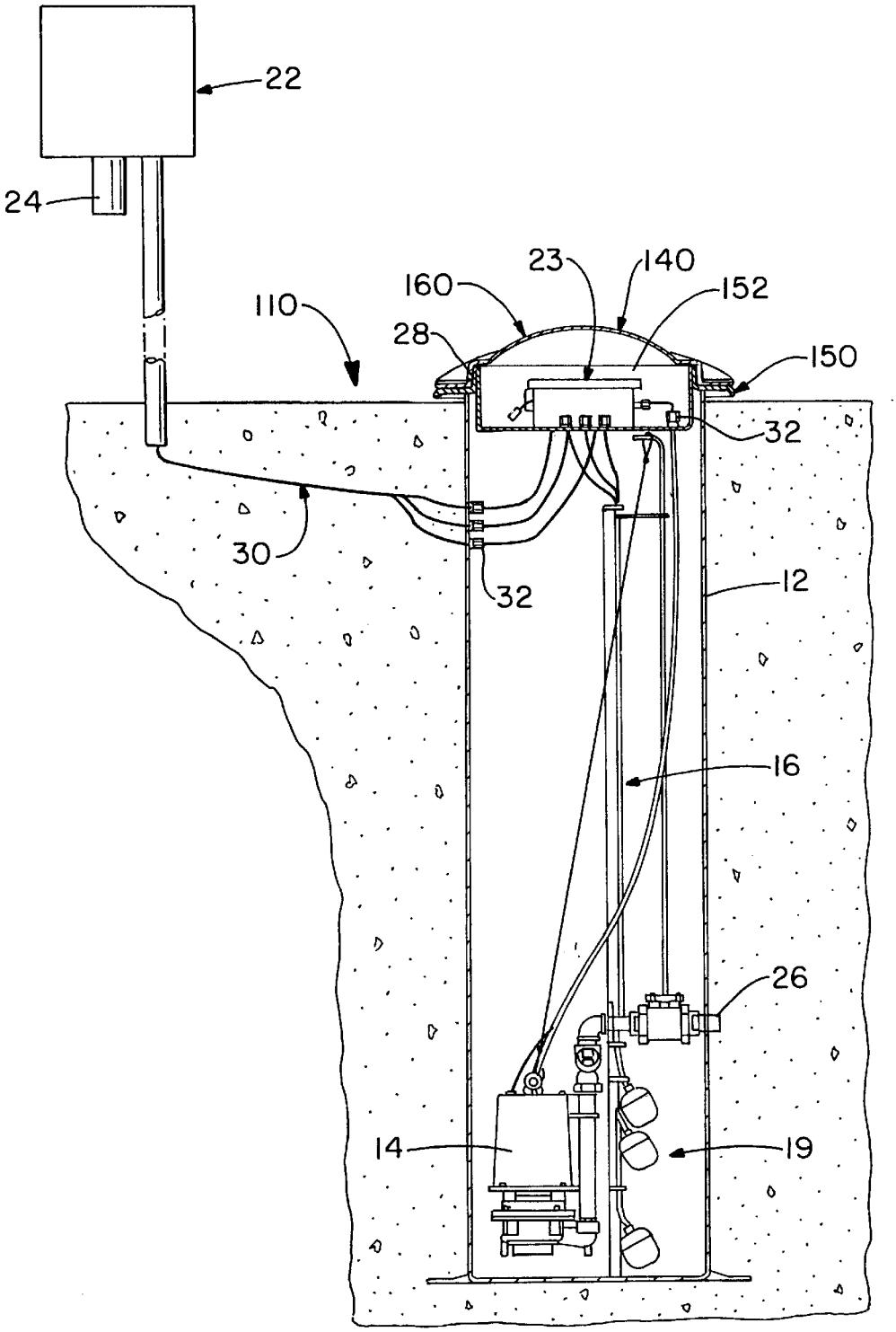
FIG. 2 shows a partial section side elevation view of a sewage basin system as in FIG. 1, but incorporating the present invention as in a retrofit.

The device 110 of the present invention is shown in FIG. 2, which is the general sewage system 10 of the prior art shown in a retrofitted condition with the basin cover 140 of the present invention. This device for collecting and transporting sewage under pressure by use of a pump 14 comprises the same generally closed basin 12, but the cover 140 for the basin is changed significantly, as will be described. The basin 12, as in the prior art, has a port or opening for receiving sewage (not shown), a port 26 for discharging low pressure sewage which is connected to the discharge side of the pump 14 and a maintenance entry port 28 which is capable of being sealed by the cover 140. In general, it should be expected that the basin 12 used in the present invention will be equivalent to that known in the prior art, permitting such prior art systems to be retrofitted with the cover 140 of the present invention in order to provide the sewage collecting and pumping device 110 of the present invention.

Attention is now directed to the cover 140 provided for the maintenance entry of the basin. In addition to FIG. 2, FIGS. 3–8 are also referenced at this point.

Rather than being a simple plate provided about its periphery with means for being sealingly affixed to flange 36 around the periphery of the maintenance entry 28, the cover 140 of the present invention comprises a lower member 150 and an upper member 160.

Figure 3:
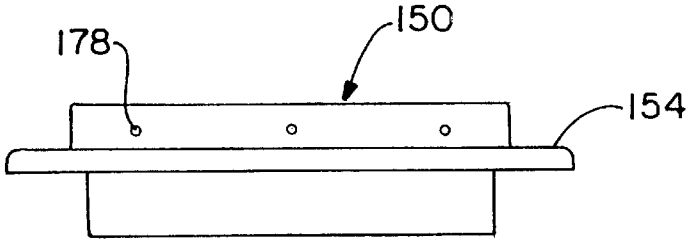
FIG. 3 shows a side elevation view of the lower member of the sewer basin cover of the present invention.
Figure 4:
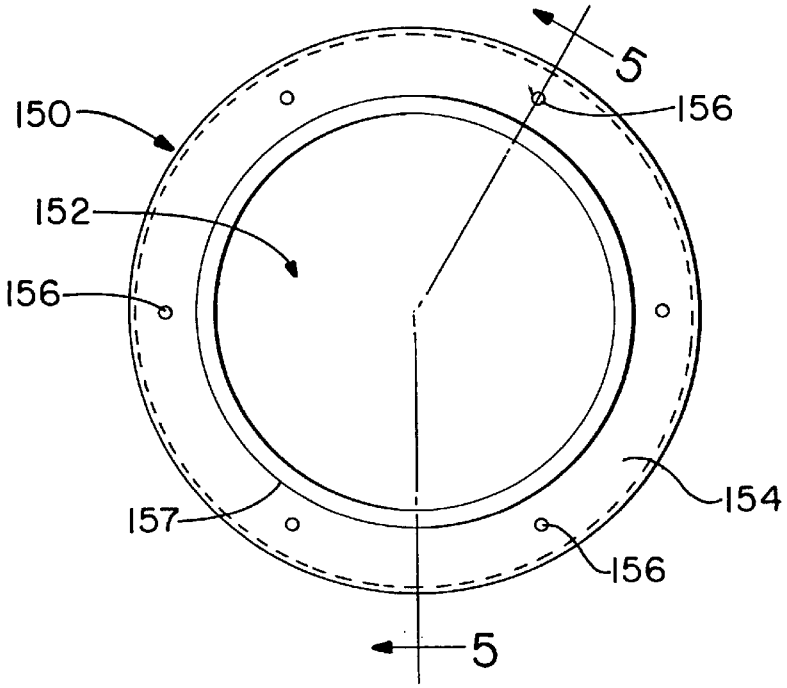
FIG. 4 shows a top plan view of the lower member of the sewer basin cover as shown in FIG. 3.
Figure 5:
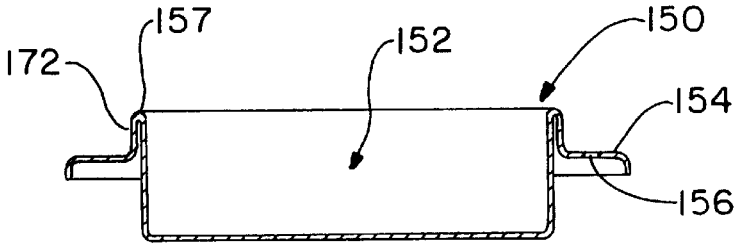
FIG. 5 shows a partial section side elevation view of the lower member of the sewer basin cover, taken along Line 5—5 of FIG. 3.

FIGS. 3 through 5 show details of the lower member 150. It is bowl-like, having a central cavity 152. A flange 154 around the outside of the lower member is adapted to register atop the flange 36 of the maintenance entry 28. Each of these flanges 154, 36 will be provided with means for sealingly affixing the flanges together. Typically, the means will be a plurality of fasteners such as bolts and nuts, a plurality of matching apertures, such as apertures 156 in flange 154, in each of the flanges 154, 36 corresponding to the size and number of the fasteners, and a sealing means, such as an elastomeric 0-ring fitted in a lip formed on the flanges or a compressible gasket fitted between the flanges. The central cavity 152 in the bowl-like lower member provides a plenum within which the control panel 23 may be mounted. In the prior art, the control panel was mounted remotely form the basin in an external control box 22 to isolate it from the basin interior and a separate junction box 18 was required inside the sewage basin, but the cover 140 of the present invention provides a plenum clearly isolated from the basin interior, even while the lower member 150 of the cover sits atop the maintenance entry 28. Therefore, it is no longer necessary to mount the control panel 23 in the exterior control box 22 and it may be mounted in the plenum or central cavity of the lower member 150. This is not to say, however, that the control panel 23 is no longer enclosed in a NEMA-type enclosure, which is still necessary to properly protect the control panel and is most probably required by code in any circumstance.

Figure 6:
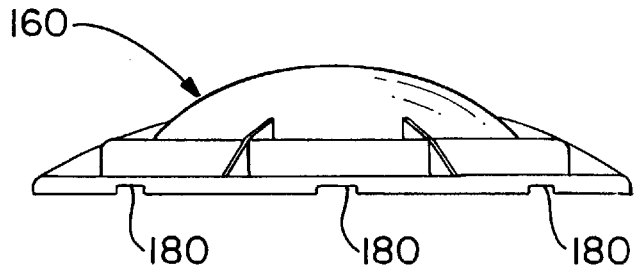
FIG. 6 shows a side elevation view of the upper member of the sewer basin cover of the present invention.
Figure 7:
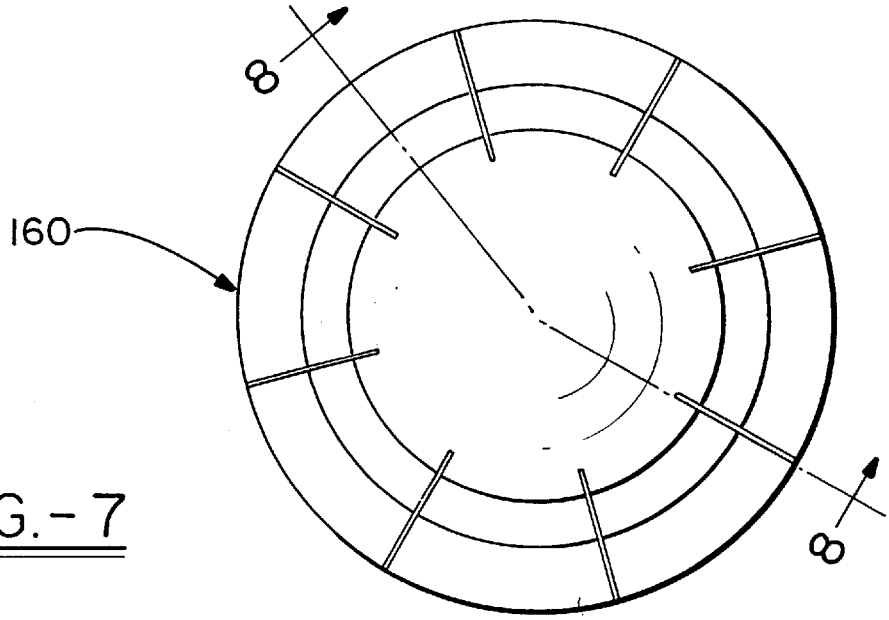
FIG. 7 shows a top plan view of the upper member of the sewer basin cover as shown in FIG. 6.
Figure 8:
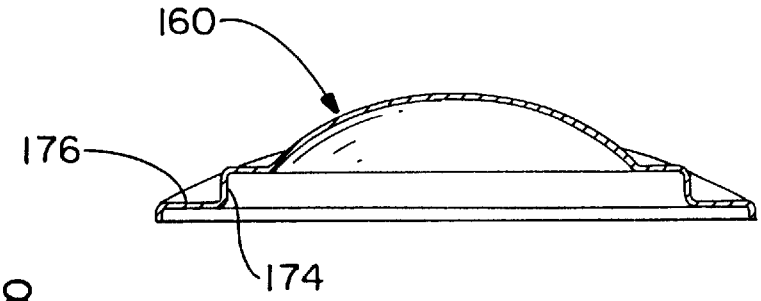
FIG. 8 shows a partial section side elevation view of the upper member of the sewer basin cover, taken along Line 8—8 of FIG. 7.

Details of the upper member 160 are provided in FIGS. 6–8. The upper member 160 of cover 140 is shown in a preferred dome shape, although it may in some applications have a disc shape. In either case it operates as a lid for the lower member 150. The upper member 160 is intended to cover and seal an exposed top rim 157 of the plenum portion of the lower member from the outside elements. For this reason, the upper and lower members 150, 160 each have one of a pair of corresponding surfaces formed thereon which act together to provide a water-tight closure to the plenum when sealingly affixed to each other. In the preferred embodiment disclosed, the lower member has a vertical cylindrical wall 172 which forms the top rim 157 for the lower member and the upper member 160 has an arcuate downwardly-turned lip 174 formed around its periphery. The upper member 160 is preferably formed from a flexible material, particularly a polymeric material such as polyethylene, polypropylene or the like and the lip 174 has dimensions such that it will frictionally engage the vertical cylindrical wall 172 of the lower member 150. In another embodiment, the means could be a plurality of fasteners such as bolts and nuts, a plurality of matching apertures in each of the corresponding surfaces corresponding to the size and number of the fasteners, and a sealing means, such as an elastomeric 0-ring fitted in a lip formed on the flanges or a compressible gasket fitted between the flanges. In this latter embodiment, there may be no need for flexibility in the upper member, since the engagement with the lower member is not frictional. In the particularly preferred embodiment shown, the lip 174 of the upper member 160 has a further radially extending flange 176 which serves to cover over the flange 154 of the lower member 150, effectively keeping rain, dirt and the like off of the fasteners used to affix the lower member and the maintenance aperture 28. The interaction of lower member 150 and upper member 160 is such that the noxious gases in the basin interior are vented out of the side edges of the rim without allowing entry into the plenum containing control panel 23.

It will be readily appreciated that this new design for the basin cover 140 places the control panel 23 directly above the pump 14 and eliminates the need for the junction box 18 previously located in the basin. This has several effects. Although it is still desirable to have an external box 22 to house the electrical disconnect and the alarm, the number of wires connecting the external control box with the basin is reduced. Instead of the fifteen leads described above, only five are now needed: four power leads and a single alarm signal lead. These wires are connected to the control box through water-proof ports made through the lower cover member. Likewise, wiring connections previously made between the pump, the level sensing means and the control panel made through the junction box are now made directly to the control panel through water-proof ports in the lower cover member. Removing the control panel 23 from the external control box 22 may allow the box to be reduced in size and rendered less obtrusive.

Although the plenum provided in the cover 140 of the present invention should be effectively water-tight, building codes will probably still require the control panel 23 to be in a NEMA-type enclosure box, and the preferred enclosure box will usually be provided with a lock 176 to control access thereto. If a locked enclosure box is used inside the plenum, the need to lock the upper member 160 to the lower member 150 may be eliminated.

Because the new cover 140 puts the control panel 23 proximate to the maintenance entry 28 of the basin 12, diagnosis of pump problems is facilitated. A single service technician can manipulate the control and directly observe action of the pump. However, the technician need not expose the fluid portion of the basin unless necessary, which would be the case if the control panel were placed inside the basin as the junction box has been in the past.

In some embodiments of the invention, it may be highly desirable to provide a lock or tamper proof fastener to the corresponding surfaces between the upperand lower cover members 150, 160 to prevent unauthorized entry into the plenum, thereby allowing access to the control panel 23.

In some embodiments of the invention, it may be highly desirable to provide a lock or tamper proof fastener to the corresponding surfaces between the lower member 150 and the maintenance entry 28, to prevent unauthorized entry into the basin.

In some embodiments, it may be highly desirable to provide at least one screened vent 178 in the flange 154 on the lower member 140, such that the basin interior is vented to the outside, but such that insects and the like are prevented from entering the basin 12. If such a screened vent 178 is positioned on a vertical surface and is hooded, especially by flange 176 on the upper member 160 and slots 180 are spaced around the periphery of the radially-extending flange of the upper member to allow free exchange of air for the screened vents, the entry of rainwater and the like through the screened vents will be minimized.

In addition to new installations in which the basin 12 is initially provided with a basin cover 140 of the type described in the present invention, it is also possible to use the cover 140 of the present invention as a retrofit for a cover 20 in the sewer basins of the existing art. In such a situation, the control panel 23 located in the external control box 22 is removed from the external control box and mounted inside the lower member 150. The junction box 18 of the prior art basin is removed from the basin 12 and the wires from the power source, pump, level sensing means and to the alarm means are run from their source directly to the control panel 23. The wires are passed through the lower member by means of water-proof seals. Sufficient slack in the length of the wires should be provided so that the entire lower member may be removed from the maintenance entry aperture without disconnecting the wires connecting the pump, level sensing means, etc. from the control panel. This is necessary to provide unimpeded access to the basin internals.

While the foregoing specification is intended to describe in detail the preferred embodiment of the invention, the scope of the invention should be determined by the appended claims.

What is claimed is:

1. An device for collecting and transporting sewage under pressure by use of a pump powered by an external electrical source, the device further comprising a level sensing means for activating and de-activating the pump and an alarm means for providing external indication of pump malfunction, and an electrical control panel and wiring for intercommunicating said pump with the external electrical source, the level sensing means and the alarm means, said device comprising:

a generally closed basin for housing the pump and level sensing means and having an aperture for receiving sewage, an aperture for discharging low pressure sewage and a maintenance entry aperture; and a cover for the maintenance entry aperture, said cover comprising a lower member and an upper member, the lower member having a central cavity for housing the control panel and being adapted to be removably fitted atop the maintenance entry aperture and provide a removable water-tight sealing closure to the basin at the maintenance entry aperture and the upper members being adapted to be removably fitted atop the lower member to seal the central cavity in a water-tight fashion.

2. The device of claim 1 wherein the lower member is bowl-like with an outwardly extending flange adapted to be fitted atop a corresponding flange on the maintenance aperture.

3. The device of claim 2 wherein the flanges on the lower member and the maintenance aperture are provided with matching apertures for receiving a plurality of fasteners.

4. The device of claim 1 wherein the lower member has a vertical cylindrical top rim and the upper member has a downwardly turned lip around the periphery, the top rim and the lip being dimensioned to provide a frictional fit.

5. A sewage collecting and pumping device containing a pump with a control panel therefor remote from said pump, said device comprising:

a basin for collecting the sewage, having a maintenance entry aperture, said pump mounted in said basin, and a cover for said maintenance entry aperture, the control panel mounted inside a cavity in said cover.

6. A cover for a maintenance entry of a sewer basin, said cover comprising:

a lower member having an outwardly-open central cavity with a top rim, said lower member being adapted to be removably secured in a water-tight manner to the maintenance entry; and an upper member having a peripheral downwardly-turned lip dimensioned to be frictionally secured to the top rim of the lower member, effectively sealing the central cavity in a water-tight manner.

* * * * *